US006619794B2

(12) United States Patent
Wade

(10) Patent No.: US 6,619,794 B2
(45) Date of Patent: Sep. 16, 2003

(54) SYSTEM AND METHOD FOR OPTIMIZING INK DRYING TIME THROUGH MULTIPLE SPACED PRINTHEADS

(75) Inventor: John M Wade, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/003,939

(22) Filed: Oct. 31, 2001

(65) Prior Publication Data

US 2003/0081099 A1 May 1, 2003

(51) Int. Cl.[7] ..... B41J 2/01
(52) U.S. Cl. ..... 347/102
(58) Field of Search ..... 347/102, 101, 347/104, 105, 106, 107, 43, 19, 12, 4, 13, 41, 42, 15, 37, 10, 9; 399/320; 346/25; 219/216; 101/488; 34/304, 381; 516/70; 8/471

(56) References Cited

U.S. PATENT DOCUMENTS

| | | | |
|---|---|---|---|
| 6,172,689 B1 | 1/2001 | Cunnagin et al. | |
| 6,375,296 B1 | 4/2002 | McGarry et al. | |
| 6,426,765 B1 * | 7/2002 | Iwasaki et al. | 347/12 |

FOREIGN PATENT DOCUMENTS

| | | |
|---|---|---|
| EP | 0829368 | 3/1998 |
| EP | 0894633 | 2/1999 |
| EP | 19743804 | 4/1999 |
| GB | 2343415 | 5/2000 |
| JP | 58-005282 | 1/1983 |

OTHER PUBLICATIONS

British Search Report dated Nov. 19, 2002.

* cited by examiner

*Primary Examiner*—Raquel Yvette Gordon

(57) ABSTRACT

The present invention is embodied in a system and method for optimizing ink drying time through the incorporation of a system of multiple spaced printheads. The printhead assembly includes connection and processing circuitry, multiple printhead bodies, ink channels, substrates, such as semiconductor wafers (commonly referred to as a die), and nozzle members. The printheads also include controllers for controlling printing on a print media and incorporating a programmable feedback loop. The loop activates the various printheads during printing so that the various data packets are added in a synchronized manner during the print swath. The present invention provides adequate drying time for inks produced in a printing swath on a wide array page. This will result in the use of water based inks compatible with ink jet materials in systems with fast raster scanning.

19 Claims, 4 Drawing Sheets

SYSTEM AND METHOD FOR OPTIMIZING INK DRYING TIME THROUGH MULTIPLE SPACED PRINTHEADS

FIELD OF THE INVENTION

The present invention generally relates to inkjet printers and in particular to a system and method for optimizing ink drying time through the incorporation of a system of multiple spaced printheads.

BACKGROUND OF THE INVENTION

Inkjet printers are commonplace in the computer field. These printers are described by W. J. Lloyd and H. T. Taub in "Ink Jet Devices," Chapter 13 of Output Hardcopy Devices (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes a printing medium, such as paper.

An inkjet printer produces a printed image by printing a pattern of individual dots at particular locations of an array defined for the printing medium. The locations are conveniently visualized as being small dots in a rectilinear array. The locations are sometimes "dot locations", "dot positions", or pixels". Pixels vary in size, the smaller the dot in the rectilinear array, means that more dots can be printed per inch of the printed medium. Smaller dots result in a more accurate rendition of the image and this in turn results in greater definition of the image. Thus, the printing operation can be viewed as the filling of a pattern of dot locations with dots of ink of specific size or from a combination of different sized dots.

Inkjet printers print dots by ejecting very small drops of ink onto the print medium and typically include a movable carriage that supports one or more print cartridges each having a printhead with a nozzle member having ink ejecting nozzles. The carriage traverses over the surface of the print medium. The width of the carriage varies among the different printers. For any line of print, the carriage may make more than one traverse and utilize a varying number of nozzles. An ink supply, such as an ink reservoir, supplies ink to the nozzles. The nozzles are controlled to eject drops of ink at appropriate times pursuant to command of a microcomputer or other controller. The timing of the application of the ink drops is intended to correspond to the pattern of pixels of the image being printed and to the physical properties of the ink and the print media.

In general, the ink is housed in a vaporization chamber with a tube leading to a nozzle exposed to the print media. Small drops of ink are ejected from the nozzles through orifices by rapidly heating a small volume of ink located in the vaporization chambers with small electric heaters, such as small thin film resistors. The small thin film resistors are usually located adjacent the vaporization chambers. Heating the ink causes the ink to vaporize and eject ink in the connecting tubing through the nozzle orifices. Specifically, for one dot of ink, an electrical current from an external power supply is passed through a selected thin film resistor of a selected vaporization chamber. The resistor is then heated and in turn heats a thin layer of ink located within the selected vaporization chamber, causing explosive vaporization, and, consequently, a droplet of ink is ejected from the nozzle and onto a print media. The vacuum created as the ink droplet is ejected from the nozzle acts as a suction pump to draw more ink into the vaporization chamber.

The temperature will be high if the resistors fire a number of times in a short period of time. As the carriage traverses in a print swath, various heater elements in the array are activated. If the traverse is narrow, the mean temperature at the beginning of the traverse will be similar to the mean temperature at the conclusion, and the effect of temperature on the pass will be consistent for all ink droplets projected onto the print media. If the swath is wide more heater elements are activated.

Prior to page wide arrays, ink jet printing was limited in speed due to raster scanning of narrow printheads. This speed has now increased. With page wide arrays, the problem now is to have inks that dry with sufficient speed to allow for multiple passes without compromising the previously printed swaths. This means that either fast drying solvent based inks, which may not be compatible with ink jet material sets, must be used, or use water based ink at very slow speeds to allow for vehicle evaporation.

Therefore, what is needed is a system and method for optimizing ink drying time through the incorporation of a system of multiple spaced printheads. The system and method would divide data into packets to be processed by separate controllers in individual printheads. The printheads would be spaced on carriages along the long axis of the print media so that each printhead prints a portion of the same print swath. As the printed data from the first printhead reaches subsequent printheads, printed data to complete the swath would be added by successive printheads. By the time the printed data from the first printhead reached the second printhead the swath would have had time to dry

SUMMARY OF THE INVENTION

To overcome the limitations in the prior art described above, and to overcome other limitations that will become apparent upon reading and understanding the present specification, the present invention is embodied in a system and method optimizing ink drying time through the incorporation of a system of multiple spaced printheads.

The printhead assembly includes connection and processing circuitry, multiple printhead bodies, ink channels, substrates, such as semiconductor wafers (commonly referred to as a die), and nozzle members. The nozzle members have heating elements in arrays, as well as plural nozzles coupled to respective ink channels. The printheads also include controllers, which can be integrated circuit processors, printer drivers, firmware or the like for controlling printing on a print media and incorporating a programmable feedback loop. The loop activates the various printheads during printing so that the various data packets are added in a synchronized manner during the print swath.

The controller can be defined in the integrated circuit as receiving the location through an index sensor during the printing process, comparing this index with the set point for printing data packets, initiating various printheads in the printhead assembly, and by a forward communication loop initiate a stepper motor to keep the print media coordinated with the printing process. The controller can be created by any suitable integrated circuit manufacturing or programming process.

The present invention provides adequate drying time for inks produced in a printing swath on a wide array page. This will result in the use of water based inks compatible with ink jet materials in systems with fast raster scanning.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview

Figure 1:
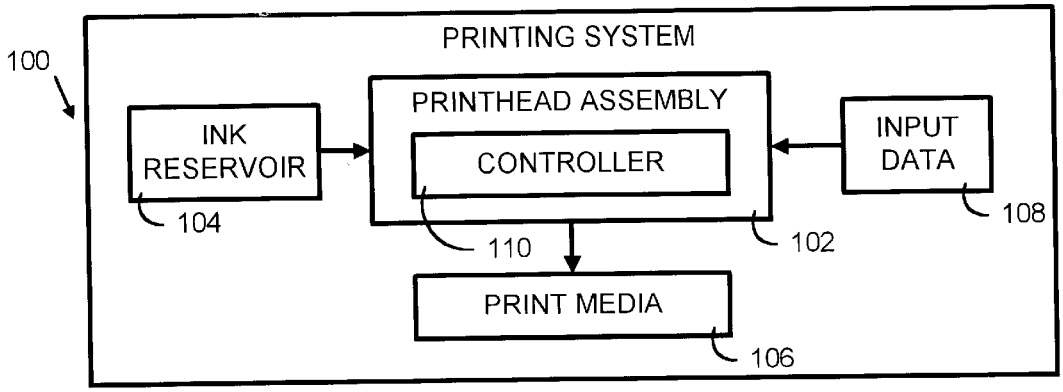
FIG. 1 shows a block diagram of an overall printing system incorporating the present invention.

FIG. 1 shows a block diagram of an overall printing system incorporating the present invention. The printing system 100 of the present invention includes a printhead assembly 102, ink supply 104 and print media 106. Input data to the printing system 100 comes from the input data channel 108. A locator controller system 110 is included in the printhead assembly 102. The controller system 110 can be an integrated circuit, firmware, a software printer driver or the like and controls the timing of the activation of the printheads.

II. Exemplary Printing System

Figure 2:
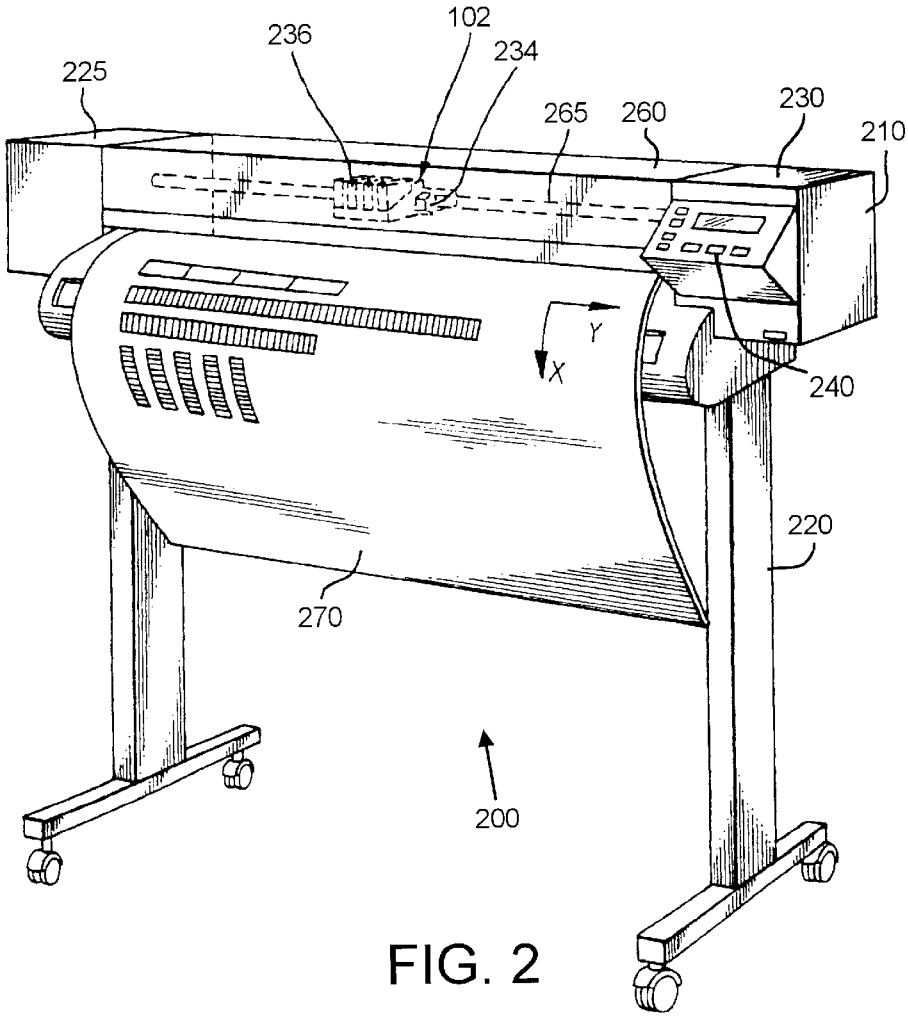
FIG. 2 is an exemplary printer that incorporates the invention and is shown for illustrative purposes only.

FIG. 2 is a perspective view of an exemplary high-speed large format printing system 200 that incorporates the invention and is shown for illustrative purposes only. The printing system 200 includes a housing 210 mounted on a stand 220. The housing 210 has a left media transport mechanism cover 225 and a right media transport mechanism cover 230 housing a left media transport mechanism (not shown) and a right media transport mechanism (not shown), respectively. A control panel 240 is mounted on the right media transport mechanism cover 230 and provides a user interface with the printing system 200.

A printhead assembly 102 with print cartridges 236 is mounted on a carriage assembly 234, all being shown under a transparent cover 260. The carriage assembly 234 positions the printhead assembly 250 along a carriage bar 265 in a horizontal direction denoted by the "y" axis A print media 270 (such as paper) is positioned by the media transport mechanism (not shown) in a vertical direction denoted by the "x" axis.

The print cartridges 236 may be removeably mounted or permanently mounted to the scanning carriage 234. Also, the print cartridges 236 can have self-contained ink reservoirs in the body of the printhead (shown in FIG. 3) as the ink supply 104 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 104 (shown in FIG. 1). As a further alternative, ink supplies 104 can be one or more ink containers separate or separable from print cartridges 236 and removeably mountable to carriage 234.

Figure 3:
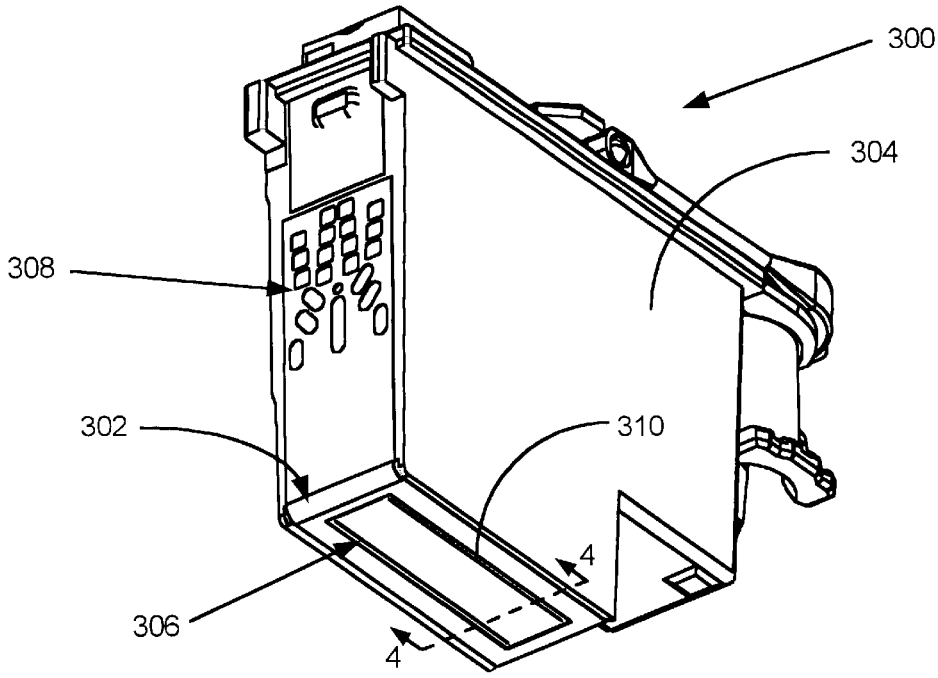
FIG. 3 shows for illustrative purposes only a perspective view of an exemplary print cartridge incorporating the present invention.

FIG. 3 shows for illustrative purposes only a perspective view of an exemplary printhead assembly 102 incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 102 is comprised of a thermal head assembly 302 and a printhead body 304. The thermal head assembly 302 can be a flexible material commonly referred to as a Tape Automated Bonding (TAB) assembly. The thermal head assembly 302 includes a nozzle system 306 and interconnect contact pads (not shown) and is secured to the printhead assembly 102. The thermal head assembly 302 can be secured to the print cartridge 300 with suitable adhesives. An integrated circuit chip (not shown) provides feedback to the printer 200 regarding certain parameters of printhead assembly 102. The contact pads 308 align with and electrically contact electrodes (not shown) on carriage 234. The nozzle system 306 preferably contains plural parallel rows of offset nozzles 310 through the thermal head assembly 302 created by, for example, laser ablation. It should be noted that other nozzle arrangements can be used, such as non-offset parallel rows of nozzles.

III. Component Details

Figure 4:
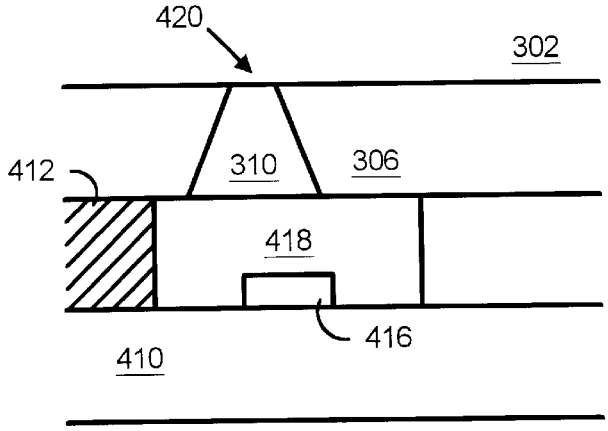
FIG. 4 is a schematic cross-sectional view taken through section line 4—4 of FIG. 3 showing the ink chamber arrangement of the print cartridge of FIGS. 1 and 3.
Figure 5:
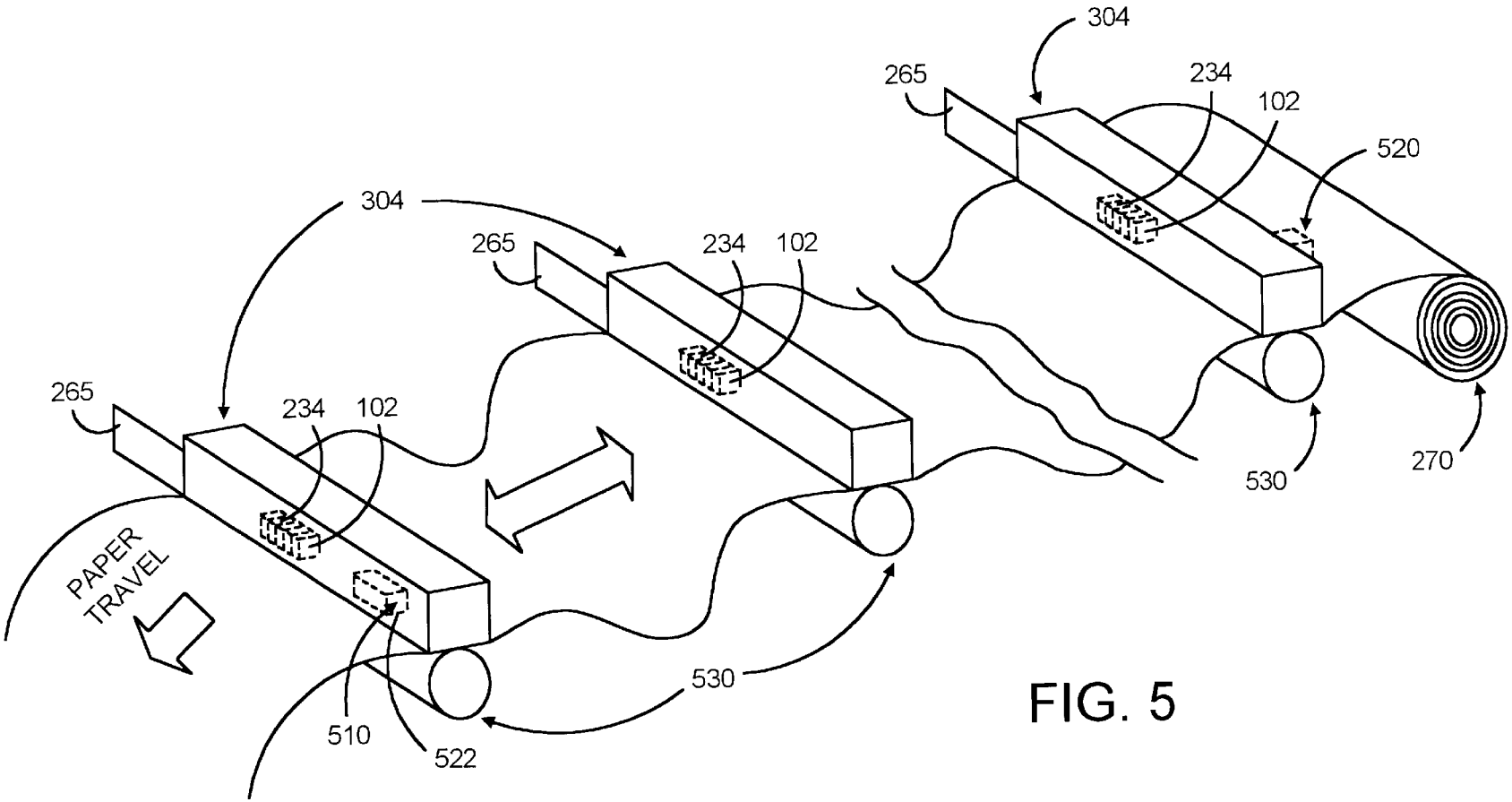
FIG. 5 shows a block diagram of the temperature sensor layout on the printhead incorporated in the present invention.

FIG. 4 is a cross-sectional schematic taken through section line 4—4 of FIG. 3 of the inkjet print cartridge 300 utilizing the present invention. A detailed description of the present invention follows with reference to a typical printhead used with print cartridge 300. However, the present invention can be incorporated in any printhead configuration. Also, the elements of FIG. 4 are not to scale and are exaggerated for simplification.

Referring to FIGS. 1–3 along with FIG. 4, as discussed above, conductors (not shown) are formed on the back of thermal head assembly 302 and terminate in contact pads for contacting electrodes on carriage 234. The other ends of the conductors are bonded to the printhead 300 via terminals or electrodes (not shown) of a substrate 410, such as a semiconductor material, commonly referred to as a die. The substrate or die 410 has ink ejection elements 416 formed thereon and electrically coupled to the conductors. The integrated circuit chip provides the ink ejection elements 416 with operational electrical signals. A barrier layer 412 is located between the nozzle member 306 and the substrate 410 for insulating conductive elements from the substrate 410.

An ink ejection or vaporization chamber 418 is adjacent to each ink ejection element 416, as shown in FIG. 4, so that each ink ejection element 416 is located generally behind a single orifice or nozzle 420 of the nozzle member 306. The nozzles 420 are shown in FIG. 4 to be located near an edge of the substrate 410 for illustrative purposes only. The nozzle 420 can be located in other areas of the nozzle member 306, such as centered between an edge of the substrate 410 and an interior side of the body 304.

Each ink ejection element 416 acts as an ohmic heater when selectively energized by one or more pulses applied sequentially or simultaneously to one or more of the contact pads via the integrated circuit. The ink ejection elements 416 may be heater resistors or piezoelectric elements and for the purposes of the current invention will be heater resistors. The orifices 420 may be of any size, number, and pattern, and the various figures are designed to simply and clearly show the features of the invention. The relative dimensions of the various features have been greatly adjusted for the sake of clarity.

Referring to FIGS. 1–4, during a printing operation, ink stored in an ink reservoir 104 defined by the printhead body 304 generally flows around the edges of the substrate 410 and into the vaporization chamber 418. Energization signals are sent to the ink ejection element 416 and are produced from the electrical connection between the print cartridges 236 and the printer 200. Upon energization of the ink ejection element 416, a thin layer of adjacent ink is superheated. The energized heater element causes explosive vaporization and, consequently, causes a droplet of ink to be ejected through the orifice or nozzle 420. The vaporization chamber 418 is then refilled by capillary action. This process enables selective deposition of ink on print media 106 to thereby generate text and images.

Referring to FIG. 5 and FIGS. 1–4 a preferred embodiment of the present invention has multiple carriage bars 265 each supporting a carriage assembly 234 and a printhead assembly 102, and inkjet printheads 304. On the printhead assembly 1, 102, is located an index creator 520. The index creator 520 creates a locator index 510 on the print media 106. In one embodiment, a locator index can be printed in the margins. In another example, the index creator 520 can create data representative of a pattern inherent in the print media, such as fiber patterns. The last carriage n, 234, has a locator sensor 522 that scans for the locator index 510 on the print media.

Figure 6:
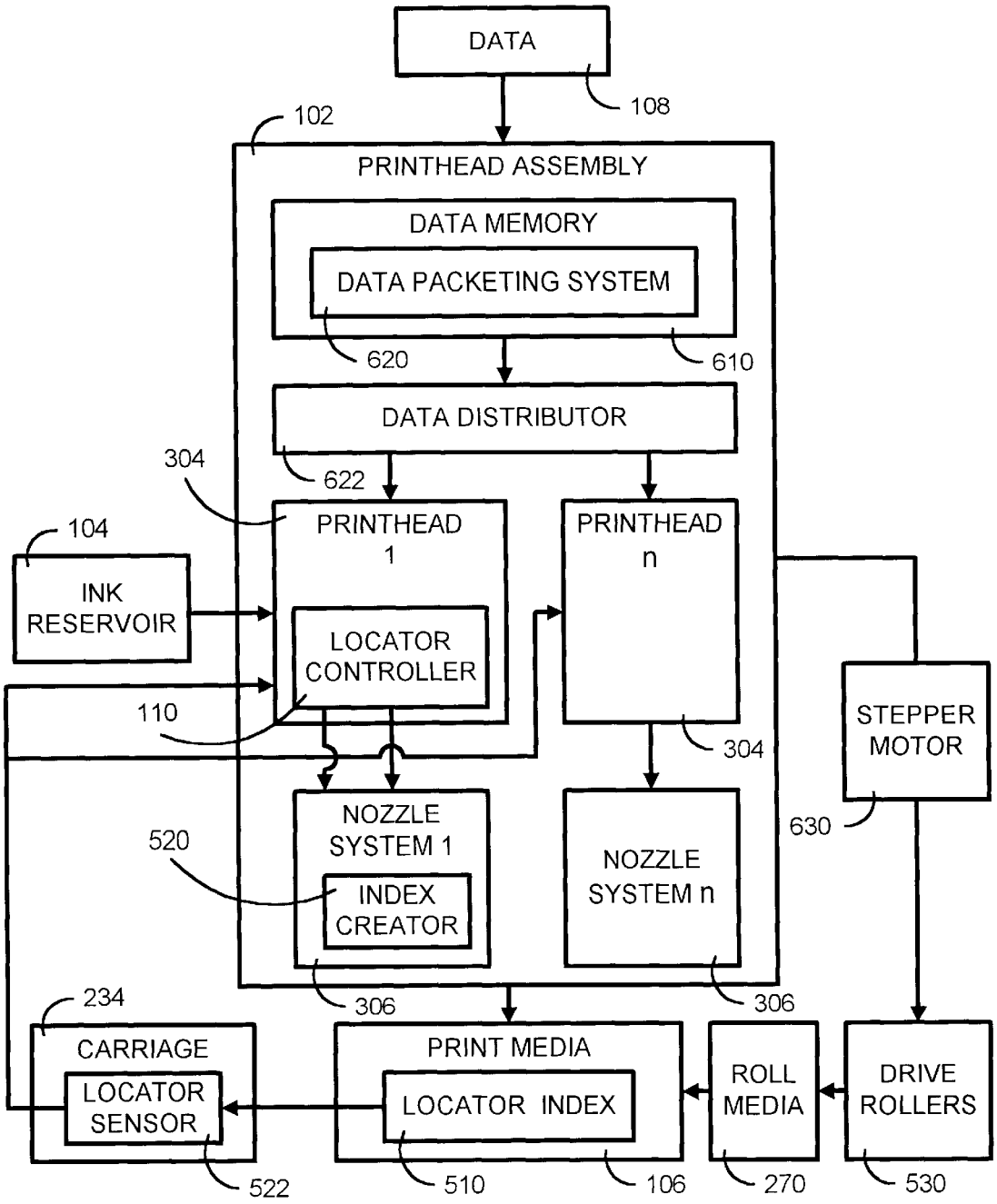
FIG. 6 shows for illustrative purposes only a perspective of a page wide array of inkjet printheads

FIG. 6 is a block diagram illustrating the operation and integration of the printhead assembly 102 of FIG. 1. Referring to FIGS. 1–4 along with FIG. 5, during a printing operation, ink is provided from the ink reservoir 104 to an interior portion of the printhead body **1-*n*, 304. The interior portion of the printhead body 1-*n*, 304 provides ink to the ink channels for allowing ejection of ink from the vaporization chambers 418 through adjacent nozzles 420**.

The printhead assembly 102 receives commands from the controller 110 to print ink based on the input data 108 and form a desired pattern for generating text and images on the print media 106. The data 108 is stored in the data memory 610 and converted into data packets by the data packeting system 620. The data packeting system 620 is a controller that divides the data into discrete swaths. These swaths are in turn divided into packets that are integral portions of the swath to be printed. Packets are distributed by the data distributor 622 to the relevant printhead **1-*n*, 304, so that when the combined output of all printheads 1-*n*, 304 is printed on the print media 106**, the image will represent the original single swath.

At the time that printhead 1, 304 is initiating the nozzle system 1, 306 to print the portion of the swath distributed to it by the data distributor 622, it simultaneously initiates the index creator 520. The index creator 520 determines a line encoder to be printed on the print media 106. In a preferred embodiment of the invention this encoder is the locator index 510.

A locator sensor 522 on the carriage 234 optically scans the locator index and forwards the position to the printhead assembly 102. The locator index 510 indicates the position of the print in relation to the nozzle system. With this positioning information the printhead assembly can determine to advance the print media by activating the stepper motor 630 which turns the drive rollers 530 and advances the print media 106.

In addition the locator sensor 522 activates the printhead assembly 102 upon reading the locator index 510. The locator index 510 indicates that the next swath of print needs to be initiated. Printhead 1, 304 forwards its portion of the next swath of data to nozzle system 1, printhead n, 304 forwards data to nozzle system n, 304 and so on; and printhead 1, 304 initiates the index creator 520 to formulate the next locator index.

As the print media emerges from printhead 1, 304 one third of the print swath will be completed in an embodiment of three printheads. Before the print media reaches the second printhead 304, the ink on the print media will be dry and the second third of the swath will be printed by the second printhead, 304. Again before the print media reaches the third printhead, 304, it will be dry and will have two thirds of the swath printed. The final third will be printed at the third printhead 304.

IV. Conclusion

In conclusion, with the system and method of the present invention, a dynamic and proactive printhead assembly is established through the locator sensor 522 feedback system. This allows the printhead assembly 102 to coordinate the timing of printing of data at the various printhead 304 and nozzle systems 306. The data to be printed is configured at the data packeting system 620 so that each printhead 304 only receives a partial swath. The part of the swath received by a printhead is such that when printed on the print media the ink will dry before the print media reaches the next nozzle system 306 in the printer array. The net effect of this invention is that a quality print will be produced within the time frame of normal raster scanning of narrow printheads. Thus it will accommodate water vehicle inks which are compatible with ink jet material sets.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A printing system for printing images on print media with improved ink drying time, comprising:

multiple spaced apart carriages, each having at least one printhead, each printhead performing a partial print operation of an entire print operation;

a sensor that senses a location of each printhead within the print media; and a controller that divides the entire print operation into the partial print operations for distribution to respective multiple printheads based on the sensed location.

2. The printing system of claim 1, wherein the printheads are spaced apart a predetermined amount to allow ink to dry between printing of each printhead.

3. The printing system of claim 1, further comprising a programmable feedback loop that uses the sensed location to activate and instruct the multiple printheads during printing.

4. The printing system of claim 3, wherein data packets that define the images are added and sent to the multiple printheads in a synchronized manner during a print swath of the multiple printheads.

5. The printing system of claim 3, wherein each printhead contains a coordinated and synchronized feedback loop.

6. The printing system of claim 1, wherein each printhead includes an index creator located on a first carriage associated with a first printhead that creates a locator index on the print media.

7. The printing system of claim 6, wherein the locator index is predetermined indicia printed in margins of the print media.

8. The printing system of claim 6, wherein the locator index creates data representative of a pattern inherent in the print media.

9. The printing system of claim 8, wherein the data representative of a pattern are fiber patterns of the print media.

10. The printing system of claim 6, wherein a last carriage associated with a last printhead has a locator sensor that scans for the locator index on the print media.

11. A method for printing an image on a print media with multiple spaced apart carriages, each having at least one printhead, comprising:

creating a locator index from a first carriage associated with a first printhead on the print media;

sensing a location of the print media using the index;

performing a partial print operation of an entire print operation; and dividing the entire print operation into the partial print operations for distribution to respective multiple printheads based on the sensed location.

12. The method of claim 11, wherein creating the locator index includes creating predetermined indicia that is printed in margins of the print media.

13. The method of claim 11, wherein the locator index creates data representative of a pattern inherent in the print media.

14. The method of claim 13, wherein the data representative of a pattern are fiber patterns of the print media.

15. The method system of claim 11, wherein a last carriage associated with a last printhead has a locator sensor that scans for the locator index on the print media.

16. A printer for printing images on print media, comprising:

multiple spaced apart carriages, each having at least one printhead, each printhead performing a partial print operation of an entire print operation;

an index creator located on a first carriage associated with a first printhead that creates a locator index on the print media;

a sensor located on a last carriage that communicates with the locator index to sense a location of each printhead within the print media; and wherein each carriage is spaced apart from one another a predetermined distance to allow ink to dry between printing of each printhead.

17. The printer of claim 16, wherein the locator index is predetermined indicia printed in margins of the print media.

18. The printer claim 16, further comprising a programmable feedback loop that uses the sensed location to activate and instruct the multiple printheads during printing.

19. The printer system of claim 16, wherein the index creator creates data representative of a pattern inherent in the print media.

* * * * *